US007687993B2

(12) United States Patent
Okafuji et al.

(10) Patent No.: US 7,687,993 B2
(45) Date of Patent: Mar. 30, 2010

(54) IMAGE DISPLAY

(75) Inventors: Michiko Okafuji, Katano (JP); Yukihiro Morita, Hirakata (JP); Shinichiro Hashimoto, Toyonaka (JP); Masatoshi Kitagawa, Hirakata (JP)

(73) Assignee: Panasonic Corporation, Osaka (JP)

( * ) Notice: Subject to any disclaimer, the term of this patent is extended or adjusted under 35 U.S.C. 154(b) by 1120 days.

(21) Appl. No.: 10/536,490

(22) PCT Filed: Nov. 25, 2003

(86) PCT No.: PCT/JP03/14967

§ 371 (c)(1),
(2), (4) Date: May 25, 2005

(87) PCT Pub. No.: WO2004/049376

PCT Pub. Date: Jun. 10, 2004

(65) Prior Publication Data

US 2006/0082301 A1 Apr. 20, 2006

(30) Foreign Application Priority Data

Nov. 28, 2002 (JP) ..... 2002-345496

(51) Int. Cl.
*H01J 17/49* (2006.01)

(52) U.S. Cl. ..... 313/582; 313/587; 445/25

(58) Field of Classification Search ..... 313/582–587, 313/500–512; 428/690, 704, 697, 639, 660, 428/657; 445/24–25; 427/66
See application file for complete search history.

(56) References Cited

U.S. PATENT DOCUMENTS

| | | | | |
|---|---|---|---|---|
| 6,011,354 | A * | 1/2000 | Tsai et al. | 313/634 |
| 6,633,117 | B2 * | 10/2003 | Shinoda et al. | 313/484 |
| 6,650,055 | B2 * | 11/2003 | Ishimoto et al. | 313/623 |
| 6,677,704 | B2 * | 1/2004 | Ishimoto et al. | 313/493 |
| 7,157,854 | B1 * | 1/2007 | Wedding | 313/582 |
| 2001/0028216 | A1 | 10/2001 | Tokai et al. | |
| 2002/0050787 | A1 | 5/2002 | Chen | |

FOREIGN PATENT DOCUMENTS

| | | |
|---|---|---|
| GB | 1 412 250 | 12/1972 |
| JP | 1-162358 | 6/1989 |
| JP | 7-147136 | 6/1995 |
| JP | 8-315737 | 11/1996 |
| JP | 11-162358 | 6/1999 |
| JP | 2000-315460 | 11/2000 |

* cited by examiner

*Primary Examiner*—Nimeshkumar D Patel
*Assistant Examiner*—Anne M Hines

(57) ABSTRACT

A technology effective for improving the luminous efficiency, lifetime, and color temperature of a PDP having phosphor layers of three colors is disclosed. A PDP comprises a plurality of narrow tubes (60) arrayed on a substrate (51). In each narrow tube (60), one of phosphor layers (61R; 61B, 61G) is formed and a discharge gas is contained. The compositions and pressures of the discharge gases are set within appropriate ranges respectively corresponding to the phosphor layers (61R, 61B, 61G). Consequently, the PDP can have a lengthened life-time and an improved luminous efficiency. Reductions of variation in breakdown voltage and adjustment of color temperature are also possible with this constitution.

5 Claims, 5 Drawing Sheets

IMAGE DISPLAY

TECHNICAL FIELD

The present invention relates to image display devices such as plasma display panel displays and a manufacturing method for such image display devices that display images by using phosphor layers of different colors to convert ultraviolet light, generated as discharge occurs, into visible light.

BACKGROUND ART

In recent years, hopes for high definition, large screen televisions such as-Hi Vision have been high and getting higher. In each of the fields of CRT, Liquid crystal displays, and Plasma Display Panels (hereafter referred to as PDP) progress has been made.

Of the above technologies, PDP in particular makes it possible to achieve a large screen with a small depth, and products in the 60-inch class have already been developed.

PDPs can be broadly divided into two types, Direct Current type (DC type) and Alternating Current type (AC type), but currently, the AC type, appropriate for increasingly large devices, is more common.

A typical AC panel discharge type PDP is constructed with a back glass panel and a front glass panel disposed opposite one another such that a space is formed between the panels. In order to form a gas discharge space, the periphery (not shown in the drawings) is sealed using a sealing material composed of a glass with a low melting point. Then, an inert gas (for example a mixture of He and Xe) at a pressure of substantially 300 Torr to 500 Torr (40-66.5 kPa) is enclosed in the space between the two plates.

Discharge electrodes are disposed in a stripe pattern on the front glass panel, and this arrangement is overlaid with a dielectric layer composed of a dielectric glass and a protective layer composed of Magnesium Oxide (MgO).

Address electrodes are disposed in a stripe pattern on the back glass panel, and a visible light reflective layer is provided so as to cover the address electrodes. On top of this arrangement, barrier ribs are disposed between the address electrodes to divide the space described above, and a phosphor layer composed of red, green or blue ultraviolet light excited phosphor is provided in the gaps between the barrier ribs.

Also, as disclosed in Japanese laid open patent application number 11-162358, a PDP having a plurality of hollow narrow tubes made of glass and arrayed on a substrate, red, green or blue phosphor layers applied to the inside surfaces of the tubes, and a discharge gas enclosed within the tubes has also proposed. In a PDP using hollow narrow tubes in this way there is no need to enclose the discharge gas between the two panels because the discharge gas is enclosed in the hollow narrow tubes, and manufacture of the PDP is therefore simplified. Also, since the hollow narrow tubes also serve as barrier ribs and the dielectric glass layer, the PDP may be lightened.

The PDP principle for light emission is basically the same as for fluorescent lighting: when an electric field is applied between electrodes and a glow discharge is generated in the discharge space, short wavelength ultra-violet light emitted from a discharge gas induces excited emission in the red, green and blue phosphors. However, in the case of a PDP, since the discharge energy to ultraviolet light conversion efficiency and the ultraviolet light to visible light conversion efficiency in the phosphor are low, it is difficult to achieve the high emission efficiency of fluorescent lighting.

There is, therefore, a desire for an improvement in the luminance and emission efficiency of a PDP.

Also, research aiming to provide a High Definition PDP's is in progress.

For example, research is also being carried out into the suppression of deterioration of the emission characteristics of the phosphor layers in a PDP.

Also, to provide a High Definition PDP, it is also important that the color temperature when white is displayed is raised by adjusting the color of each colored cell.

DISCLOSURE OF THE INVENTION

An object of the present invention is to provide an effective technology to improve characteristics such as the lifetime, the luminous efficiency and the color temperature of an image display apparatus such as a PDP, which displays an image by converting ultraviolet light, generated as discharge occurs, into visible light via phosphor layers of various colors.

To achieve this object, the present invention is an image display apparatus in which a plurality of narrow tubes are disposed so as to extend across a substrate, each narrow tube containing phosphor material and enclosing discharge gas, the image display apparatus displaying an image by applying voltages to the narrow tubes so as to cause discharges to occur therein, and converting ultraviolet light generated as the discharges occur into visible light via the phosphor material, wherein, the plurality of narrow tubes include at least one first narrow tube and at least one second narrow tube, and the phosphor materials respectively contained in the first and second narrow tubes differ from each other, and the discharge gases respectively enclosed in the first and second narrow tubes differ from each other in at least one of composition and pressure.

It is preferable that the image display apparatus having the above characteristics is manufactured using an image display apparatus manufacturing method, the method including: a gas enclosing step of enclosing discharge gas within a plurality of narrow tubes containing phosphor material; and a disposing step of disposing so as to extend across a substrate the plurality of narrow tubes in which the discharge gas was enclosed in the enclosing step.

According to this manufacturing method, if the first narrow tubes that contain phosphor material, and the second narrow tubes, which contain phosphor material that differs from the phosphor material contained in the first narrow tubes, are provided, the discharge gas enclosed in the first narrow tube and the discharge gas enclosed in the second narrow tube can easily be made to differ from each other in at least one of composition and pressure.

Since, in an image display apparatus such as a PDP, the phosphors are usually provided in three colors (red, green and blue), the phosphor material contained in the first narrow tube may be of at least one color selected from red, green and blue, and the phosphor material contained in the second narrow tube may be of at least one color other than the at least one color selected for the phosphor contained in the first narrow tube.

The phosphor materials contained in the contained in the narrow tubes may, for instance, be melted into glass that forms the narrow tubes or provided on the inside surface of the narrow tubes.

In the image display apparatus, it is desirable that a plurality of first electrodes are arrayed so as to extend in a length direction of the narrow tubes, and a plurality of second electrodes are arrayed so as to extend in a direction which intersects the length direction of the narrow tubes such that an external driving circuit can apply a voltage to each narrow tube.

Here, to obtain a favorable discharge efficiency, it is desirable that the plurality of first electrodes are provided between the substrate and the narrow tubes, and the plurality of second electrodes are attached to the plurality of narrow tubes.

Also, it is also desirable that a layer composed of MgO is formed inside each narrow tube.

Also, included in the present invention is an image display apparatus in which a pair of substrates are disposed opposite one another such that an internal space is formed therebetween, electrodes and at least two types of phosphor layer are provided between the substrates, and discharge gas is enclosed in the internal space, the image display apparatus displaying an image by applying voltages to the electrodes so as to cause discharges to occur in the internal space, and via the phosphor material, converting ultraviolet light generated as discharges occur into visible light, wherein, the internal space is divided into a first space provided with a first phosphor layer and a second space provided with a second phosphor layer, and the discharge gases respectively enclosed in the first and second spaces differ from each other in at least one of composition and pressure.

It is preferable that the image display apparatus of the type described above is manufactured using an image display apparatus manufacturing method including: an outer vessel forming step of forming an outer vessel in which pair of substrates are disposed opposite one another such that an internal space is formed therebetween, electrodes and at least two types of phosphor layer are provided between the substrates, and discharge gas is enclosed in the internal space, the internal space is divided into a first space provided with a first phosphor layer and a second space provided with a second phosphor layer, and first and second exhaust tubes connecting to the first and second spaces respectively are provided; and an exhausting-enclosing step of, via the first and second exhaust tubes respectively, exhausting the first and second spaces and enclosing discharge gas therein.

Since, in an image display apparatus such as a PDP, the phosphors are usually provided in three colors (red, green and blue) the first phosphor layer may be of at least one color selected from red, green and blue, and the second phosphor layer may be of at least one color other than the at least one color selected for the first phosphor layer.

Usually, for an image display device such as the one described above, if the internal space is partitioned into a plurality of spaces by a plurality of barrier ribs provided in a stripe pattern, and each groove formed between the plurality of barrier ribs is closed at one end, the division of the internal space into a first space and a second space can easily be achieved.

As well as noting that the luminous efficiency and the effect on factors such as the discharge voltage are different for each type of phosphor, the inventors looked at the effect of the composition and pressure of the discharge gases on factors such as the luminous efficiency, discharge voltage, and emission color.

Specifically, points 1-4 are notable.

1. The effect on the discharge voltage is different depending on the type of phosphor layer provided in a discharge cell. On the other hand, the discharge voltage is also affected by the composition and pressure of the discharge gas.

2. The efficiency of the conversion from ultraviolet light to visible light is different depending on the type of phosphor layer. On the other hand, the luminous efficiency differs according to the composition and pressure of the discharge gas.

3. The color of the emission from a discharge cell is affected not only by the type of phosphor layer, but also by the composition and pressure of the discharge gas.

4. The composition and pressure conditions of the discharge gas that influence characteristics such as the lifetime of the phosphor layers differ for each type of phosphor.

Based on this knowledge, the present invention has made it possible to improve characteristics such as the lifetime of the phosphor layers, to adjust the emission luminance for each color, and to suppress variation in the discharge voltage between the spaces where the phosphor layers of the various colors are provided. These effects are achieved by varying the composition and pressure conditions of the discharge gas (by fixing the composition and pressure of each discharge gas separately) for each type of phosphor layer.

Thus, since the appropriate ranges of pressure and composition for a suitable discharge gas to allow each type of phosphor layer to achieve a long lifetime are often different as described above, if the pressure and composition of the discharge gas are substantially the same throughout the image display apparatus, it is not possible to set a discharge gas pressure and composition that is optimum for all the phosphors. Also, since the effect of each color of phosphor on the discharge starting voltage is different, if the pressure and composition of the discharge gas are substantially the same throughout the image display apparatus, the discharge starting voltage be caused to vary depending on the color of each phosphor. Also, if the pressure and composition of the discharge gas are substantially the same throughout the image display apparatus, the effect of discharge gas on the color of emission from the phosphors of each color is uniform. It is not, therefore, possible to separately adjust the emission color of each phosphor using the discharge gas, and hence, it is difficult to adjust the color temperature when white is displayed.

According to the present invention, however, since at least one of the composition and the pressure of the discharge gas may be varied between the first narrow tubes and the second narrow tubes (or a between a first space and a second space), at least one of the composition and the pressure of the discharge gas can be adjusted to fit the characteristics of the phosphor material (phosphor layer) included in each narrow tube (or each space).

For example, a composition and pressure of the discharge gas suitable for a long lifetime for the phosphor material (phosphor layer) included in each narrow tube (or each space) can be fixed. Also, even if the phosphor included in each narrow tube (or space) affects the discharge starting voltage differently, variation in the discharge starting voltage can be suppressed by adjusting the composition and pressure of the discharge gas in each narrow tube (or each space). Also, since the emission color from the phosphor included in each narrow tube (or in each space) can be adjusted separately via the discharge gas, the color temperature when white is displayed can be simply adjusted.

Hence, according to the present invention a High Definition image display device can be provided.

BEST MODE FOR CARRYING OUT THE INVENTION

The following describes embodiments of the present invention.

First Embodiment (Overall Construction of a PDP)

Figure 1:
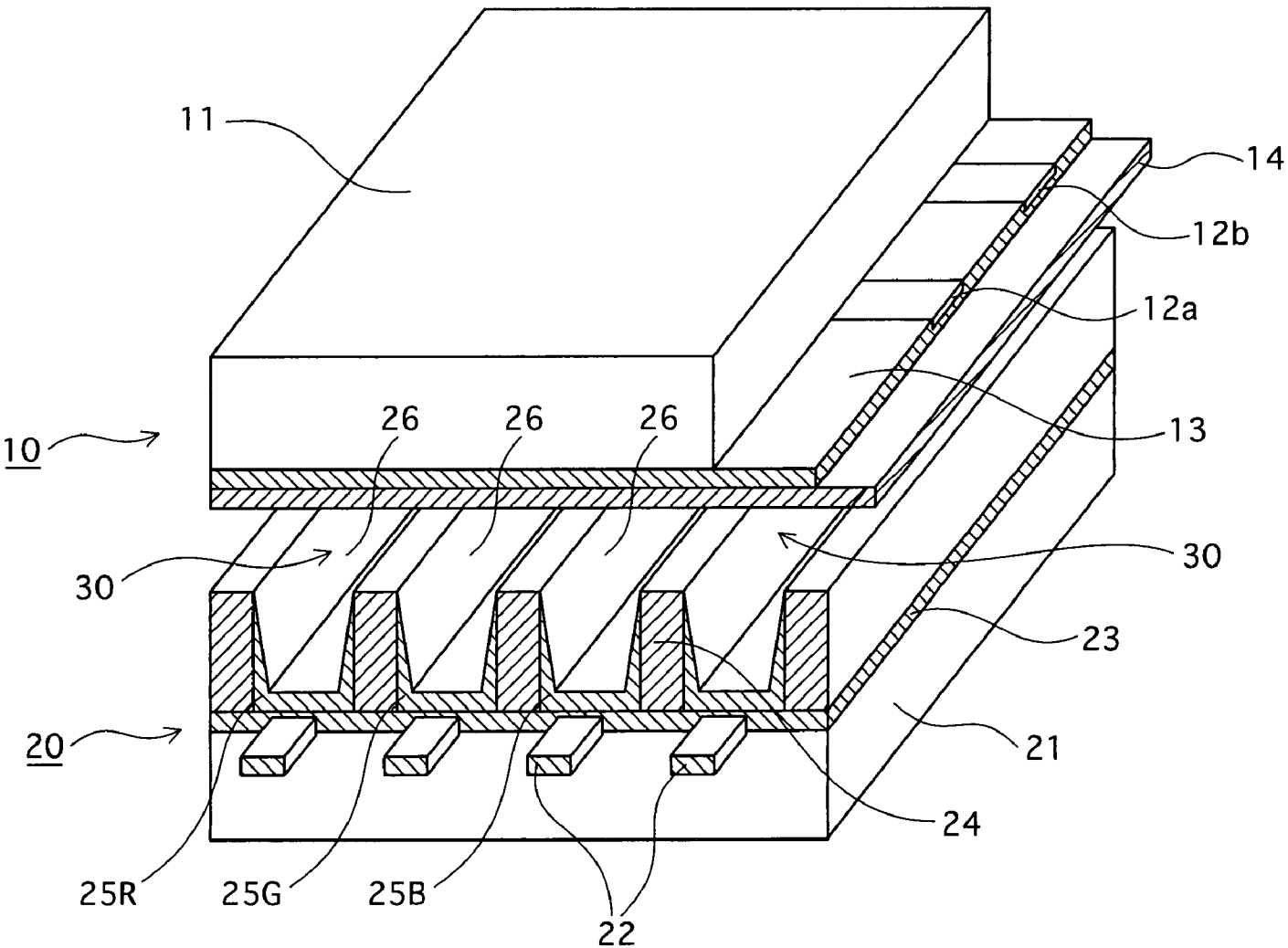
FIG. 1 is a perspective view of part of a PDP of a First Embodiment.

FIG. 1. is a perspective view of part of a PDP of the Embodiment 1.

The PDP of this embodiment is constructed as follows. A front glass panel 10 and a back glass panel 20 are disposed opposite one another. In order to form a space 30 for a gas discharge, the periphery is sealed using a sealing material 40 (omitted from FIG. 1; refer to FIG. 2) composed of a glass with a low melting point. An inert gas (for example a mixture of He and Xe or a mixture of Ne and Xe) at a pressure of substantially 300 Torr to 500 Torr (40-66.5 kPa) is enclosed in the space 30 between the two plates.

To form the front panel 10, a plurality of pairs of discharge electrodes 12*a* and 12*b* are arrayed in a stripe pattern on the facing surface of the front substrate 11 (i.e. the surface that faces the back panel). This arrangement is overlaid with a dielectric layer 13 composed of a dielectric glass, and a protective layer 14 composed of MgO. The protective layer 14 is formed using a vacuum deposition method or the like.

To construct the back panel 20, a plurality of data electrodes 22 are disposed in a stripe pattern on the facing surface of the back substrate 21 (i.e. the surface facing the front panel). A visible-light reflective layer 23 is provided so as to cover this arrangement. On top of the reflective layer 23, barrier ribs 24 are formed in a stripe pattern to divide the space 30, and phosphor layers 25R, 25G and 25B composed of red, green and blue ultraviolet excited phosphors are provided in the gaps (grooves 26) between the barrier ribs 24.

Examples of some possible colored phosphors include $Y_2O_3$:Eu for a red phosphor, $ZnSiO_4$:Mn for a green phosphor and $BaMgAl_{10}O_{17}$:Eu for a phosphor.

In a PDP of the above construction, discharge cell is formed at each point where the discharge electrodes 12*a* and 12*b* and the data electrodes 22 cross, and the external driving circuit applies a write voltage between the data electrodes 2-2 and the discharge electrodes 12*a* and applies a sustain voltage between electrodes 12*a* and 12*b*. This causes discharge in the discharge cells that were written to, and light of the corresponding color is emitted from the phosphor layers 25R, 25G and 25B.

Characteristics and Effects of a PDP According to the Present Embodiment

Figure 2:
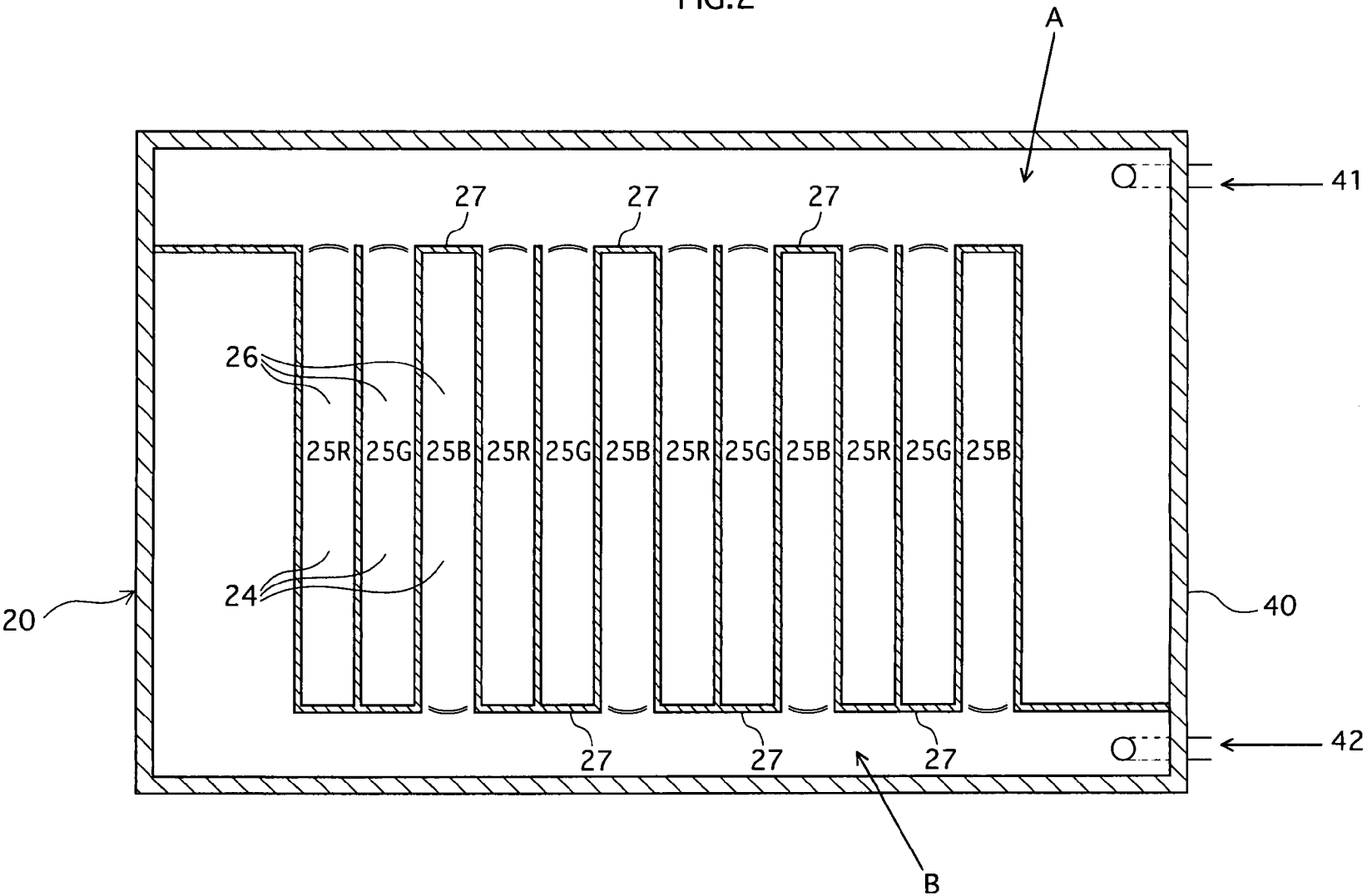
FIG. 2 is a schematic cross-section of a PDP sectioned parallel to the barrier ribs.
Figure 3:
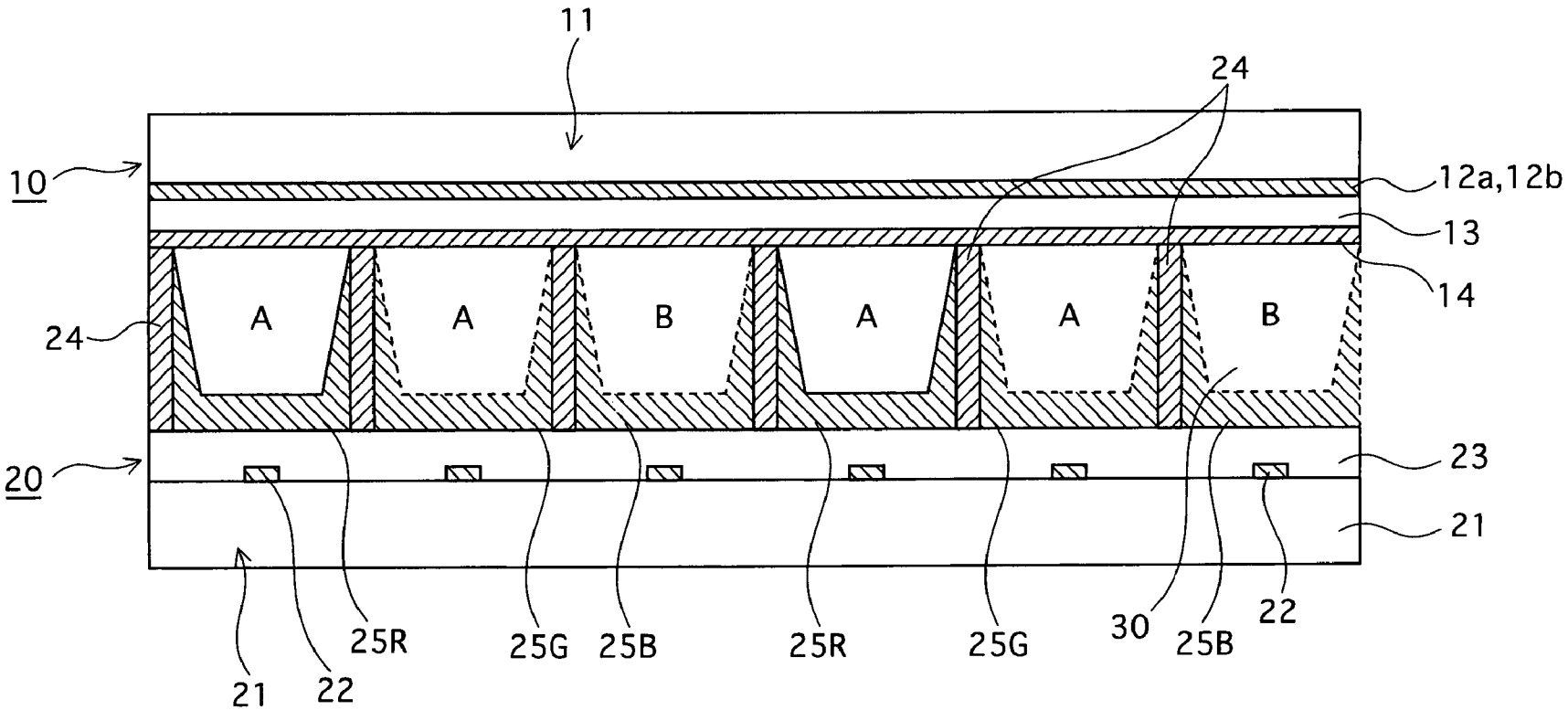
FIG. 3 is a cross-section of the PDP sectioned perpendicular to the barrier ribs.

FIG. 2. is a schematic cross-section of a PDP sectioned parallel to the barrier ribs. FIG. 3. is a cross-section of the PDP sectioned perpendicular to the barrier ribs Grooves 26 are formed between the barrier ribs 24 and phosphor layers 25R, 25G and 25B are formed in respective grooves 26 as shown in FIG. 2.

Of the two end parts of each groove 26, one or the other is closed with an auxiliary barrier rib, dividing the internal space 30 into a first space A and a second space B. Here, the three colored phosphor layers 25R, 25B, 25G are divided such that two colored phosphor layers are included in the first space A, and the remaining colored phosphor layer is included in the second space B.

Barrier ribs 24 and auxiliary barrier ribs 27 are formed from a material that has good sealing properties, and the upper part of each wall is joined to the protective layer 14 (see FIG. 3). With this construction, the first space A and the second space B are sealed off from each other.

A discharge gas is enclosed in both the first space A and the second space B. However, in each space, one or both of the pressure and the composition of the discharge gas are adjusted to be within suitable ranges to achieve some objective, the adjustments corresponding to the characteristics of the phosphor layer of the space in question.

For example, the composition and pressure of the discharge gas may be set with the objective of obtaining a high luminous efficiency and a long lifetime.

Specifically, the suitable ranges for the composition and pressure of the discharge gas often differ for each discharge space in which a phosphor layer 25R, 25G, 25B is formed, in which case it is not possible to fix the pressure and composition within ranges appropriate for each color if the pressure and composition of the discharge gas are uniform across the whole panel as for a conventional PDP. On the other hand, in the present embodiment, a higher luminous efficiency and a longer lifetime can be obtained for the panel as a whole by setting the pressure and composition of the discharge gas within ranges suitable to obtain both a long life and high luminous efficiency in each phosphor layer in space A and space B respectively.

Furthermore, the composition and pressure of the discharge gas may be set with the objective of adjusting the discharge starting voltage.

Specifically, since each color of phosphor layer affects the starting discharge voltage differently, a variation in the discharge voltage occurs when the pressure and composition of the discharge gas are uniform across the whole panel, as for a conventional PDP. In regard to this problem, if the pressures and compositions are set separately for space A and space B respectively as for the present embodiment, the discharge starting voltage may also be adjusted via the discharge gas pressure and composition and, therefore, the variation in the discharge starting voltage can be reduced in the panel as a whole.

Moreover, the composition and pressure of the discharge gas may be set with the objective of adjusting the emission color.

Specifically, the emission color of each discharge cell is affected not only by the phosphor layer, but also by the composition and pressure of the discharge gas. However, if the pressure and composition of the discharge gas are uniform across the whole panel, as for a conventional PDP, the emission color of the discharge cells cannot be adjusted via the discharge gas for space A and space B respectively. In regard to this problem, according to the present embodiment, the emission color can be adjusted via the discharge gases for the space A and the space B respectively. This means that color temperature adjustment may easily be achieved.

When the discharge voltage, the emission temperature or the like is adjusted via the composition and pressure of the discharge gas, increasing the quantity of Ne contained in the space, increases red emission. Increasing the quantity of Xe contained in a space, on the other hand, increases the quantity of ultraviolet light, and causes the discharge voltage to rise. Therefore, in general, it is preferable that the quantity of Ne is increased for the space including a red phosphor layer, and reduced for the spaces including a green phosphor layer or a blue phosphor layer, especially for the space including a blue phosphor layer, and He or Kr included instead. Also, when a space includes a blue phosphor layer, it is further preferable to increase the quantity of Xe contained, since an increase the luminous intensity of blue is generally desirable.

In this way, according to the present embodiment, it is possible to have a PDP with a long life, a high color temperature and a low discharge voltage variation between cells of each color. A reduction in the variation of the discharge voltage between cells of each color has the beneficial effect of reducing defective discharge when the PDP is being driven.

Note also that the composition and pressure of the discharge gas, and the combination of the discharge gas and a particular type of phosphor layer may also be set for another objective. Of course, it is possible to vary only the compositions of the discharge gases in the first space A and the second space B, while keeping the enclosing pressures constant, to vary only the enclosing pressures while keeping the compositions constant, or to vary both the compositions and the enclosing pressures.

The following is a description of an example of how to adjust the composition and pressure of a discharge gas.

EXAMPLE 1

In the example shown in FIG. 2 and FIG. 3, the grooves 26 in which a red phosphor layer 25R and a green phosphor layer 25G are formed are closed at one end (the lower part in FIG. 2) by the auxiliary barrier ribs 27, and the grooves 26 in which blue phosphor layers 25B are formed are closed at the other end (the upper part in FIG. 2) by the auxiliary barrier ribs 27. With this construction, the phosphor layers 25R and the phosphor layers 25G are included in the first space A and the phosphor layers 25B are included in the second space B.

A mixed gas of He and Xe, a mixed gas of Ne and Xe and the like may be used as discharge gases. Here, in the first space, which includes the red phosphor layers 25R and the green phosphor layers 25G, the fraction of Xe contained in the discharge gas is set low (5% by volume), and in the second space B, which includes the blue phosphor layer 25B, the fraction of Xe contained in the discharge gas is set high (10% by volume). Further, the first space, which includes the red phosphor layer 25R and the green phosphor layer 25G, is filled with the discharge gas at a pressure of 400 Torr (53.2 kPa), and the second space B, which includes the blue phosphor layer 25B, is filled with the discharge gas at a pressure of 500 Torr (66.5 kPa).

Thus, the quantity of Xe contained in the first space A is greater than the quantity contained in the second space B, and the amount of ultraviolet light irradiating the blue phosphor layer 25B can be increased to be greater than for the red phosphor layer 25R and the green phosphor layer 25G. Thus, the amount of blue emission can be improved and the color temperature when white is displayed can be increased.

EXAMPLE 2

Here an example of settings for the compositions of the discharge gases is described for the case where, unlike the example in FIG. 2, green and blue phosphor layers are provided in the first space A and red phosphor layers are provided in the second space B.

In the first space A, which includes green phosphor layers and blue phosphor layers, a typical gas composition is used (for example, Xe making up 5% by volume of a mixed gas of Ne and Xe), whilst in the second space B, which includes red phosphor layers, a gas composition with a greater quantity of Ne (for example, Xe making up 10% by volume of a mixed gas of Ne and Xe) is used.

With these settings, in the first space A, a balance is established between discharge voltage and discharge efficiency by using the typical gas composition ratio, and in the second space B, color purity and discharge efficiency can be improved due to the extra red emission because of the Ne supplementing the emission from the red phosphor layers.

EXAMPLE 3

Here an example of possible pressure settings and compositions for the discharge gases is described for the case that red and blue phosphor layers are provided in the first space A and green phosphor layers are provided in the second space B.

Though dependent to some extent on the materials chosen for the phosphors of each color, there is a tendency for variation in the discharge voltage to occur between each color of discharge cell due to a tendency for the discharge voltage of the discharge cells having green phosphor layers to be lower than the discharge voltages for the discharge cells having red phosphor layers and green phosphor layers.

For this kind of case, in the first space A, which includes red phosphor layers and a blue phosphor layers, a regular gas composition (for example, Xe making up 6% by volume of a mixed gas of Ne and Xe) and a regular pressure are set, while in the second space B, which includes a green phosphor layer, a gas composition with a higher proportion of Xe (for example, Xe making up 10% by volume of a mixed gas of Ne and Xe), or a higher enclosing pressure, are set. With this construction, the discharge voltages in the second space B are adjusted upwards and a reduction in the variation of the discharge voltage is therefore possible. Moreover, the quantity of ultraviolet light irradiating the green phosphor increases, and hence, the luminance of the green cells can be increased while maintaining the color purity of the green cells.

(PDP Manufacturing Method)

Front Panel 10:

The electrodes 12*a* and 12*b* are formed by printing a silver paste photosensitized with an organic vehicle onto the front surface of substrate 11 using a photo-patterning method, and after drying, exposing the electrode pattern using a photo mask, developing, and firing the arrangement.

Next, the dielectric layer 13 is formed by printing on a paste of low-melting-point lead glass, and after drying, firing the arrangement. A protective layer composed of MgO is formed on top of the dielectric layer 13 using an electron beam evaporation method.

Back Panel 20:

Next, data electrodes 22 are formed on the back substrate 21 by patterning a thick film silver paste using a screen printing method, and firing the arrangement.

Next, the visible light reflective layer 23 is formed by printing on an insulating glass paste to cover the data electrodes 22 using a screen printing method, and firing the arrangement.

Next, the barrier ribs 24 and the auxiliary barrier ribs 27 are produced by patterning a thick film silver paste using a screen printing method and then firing the arrangement.

Then, the phosphor layers 25R, 25G, 25B are formed by patterning phosphor ink onto the inner surfaces of the grooves 26 formed between the barrier ribs 24 using a screen printing method, and then firing the arrangement.

The Bonding of Front Panel 10 and Back Panel 20:

Front panel 10 and back panel 20 are put together using via a glass frit inserted between the outside edge parts of the two members. At this time, the glass frit is also applied to top parts of barrier ribs 24 and auxiliary barrier ribs 27. Then, by bonding back panel 20 and front panel 10 by way of heat-softening the glass frit, an outer vessel is created. At this time, an exhaust tube 41, which connects to the first space A, and an exhaust tube 42, which connects to the second space B, are fitted.

In the outer vessel created in this way, two sealed partitioned spaces, the first space A and the second space B, are formed between the front substrate 11 and the back substrate 21, the exhaust tube 41 connecting the first space A to the outside, and the exhaust tube 42 connecting the second space B to the outside.

Exhaust and Gas Enclosing:

After exhausting the spaces through the exhaust tube 41 and the exhaust tube 42, the discharge space A is filled with a discharge gas via the exhaust tube 41, the discharge space B is filled with a discharge gas via the exhaust tube 42, and the exhaust tube 41 and the exhaust tube 42 are then sealed.

Embodiment 2

(Overall Construction of a PDP)

Figure 4:
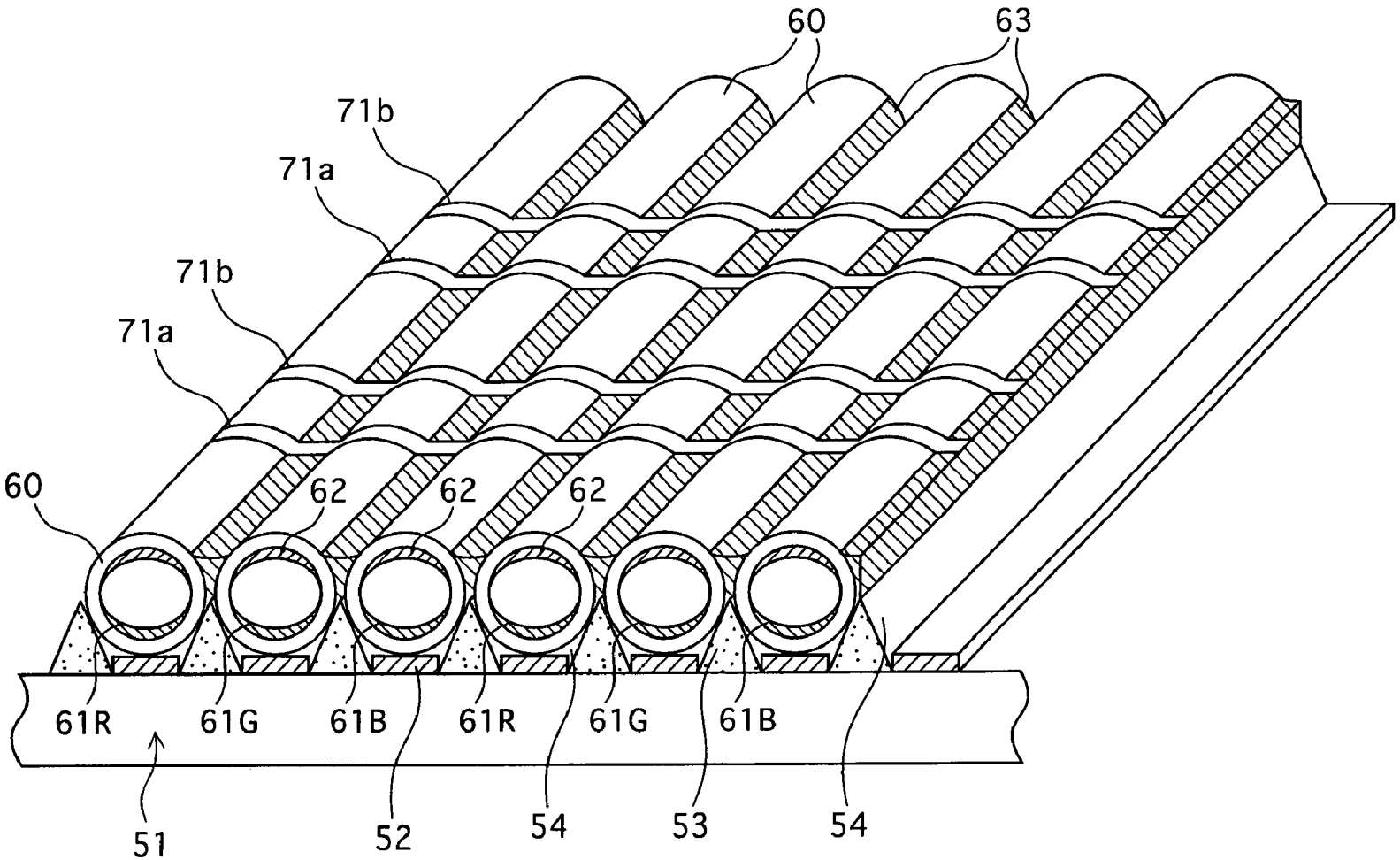
FIG. 4 is a perspective view of a PDP of a Second Embodiment.

FIG. 4 is a perspective view of the construction concept for a PDP of a Second Embodiment.

To construct this PDP, narrow hollow tubes 60 containing red, green and blue phosphors and discharge gases are arrayed on a substrate 51 in the stated order, the discharge gases being enclosed within the hollow tubes, and at least one of the composition and pressure of each enclosed discharge gas being adjusted according to the type of phosphor.

Following is a description of the construction.

A plurality of ribs 53 and a plurality of data electrodes 52 are formed in stripe patterns respectively on a substrate 51, which is a plate composed of either glass or plastic.

Grooves 54 are formed between the ribs 53, and the data electrodes 52 extend along the bottom of these grooves. Then the plurality of narrow tubes 60 is arrayed so as to fit into the grooves 54.

On the internal surface of each narrow tube 60, a red phosphor layer 61R, a green phosphor layer 61G or a blue phosphor layer 61B is provided on the substrate 51 side, an MgO layer is provided on the opposite side.

Though not shown in the drawings, both end parts of each narrow tube 60 are sealed, and a discharge is gas enclosed within each narrow tube 60.

Joining layers 63, which fix neighboring narrow tubes 60 together, are provided between the narrow tubes 60.

Furthermore, a plurality of discharge electrodes 71*a* and 71*b* is arrayed so as to span across the plurality of narrow tubes 60.

Note also that, though the forming of an MgO layer 62 is not indispensable, it is preferable because of the resulting improvement in the discharge efficiency inside the narrow tubes when the PDP is driven.

In a PDP of the above construction, discharge cell is formed at each point where the discharge electrodes 71*a* and 71*b* and the data electrodes 52 cross, and the external driving circuit applies a write voltage between the data electrodes 52 and the discharge electrodes 71*a* and applies a sustain voltage between electrodes 71*a* and 72*b*. This causes discharge in the discharge cells that were written to, and light of the corresponding color is emitted from the phosphor layers 61R, 61G and 61B.

Characteristics and Effects of a PDP According to the Present Embodiment

In a PDP of the present embodiment, a phosphor layer 61R, 61G and 61B is enclosed together with a discharge gas in each narrow tube 60. Thus, in the same way as described for the Embodiment 1 above, both the pressure and the composition of the discharge gas may be set separately to achieve some objective, the settings fitting the characteristics of the phosphor layers 61R, 61G and 61B.

Also, since the pressure and composition of the discharge gas can be set for each narrow tube 60 individually, the pressure and composition of the discharge gas can be set more precisely within suitable ranges, compared with when the space is divided into two as in the First Embodiment.

For example, the pressure and composition of the discharge gas can be set to suitable ranges for each narrow tube 60, even if the suitable ranges for the composition and pressure of the discharge gas to obtain a high luminous efficiency and a long life are different for each of the three colors of phosphor layer. Also, since the discharge starting voltage can also be adjusted for each color, adjustment of the color temperature is easily achieved.

Following is a description of examples-of settings for the composition and pressure of the discharge gas.

A mixed gas of He and Xe, a mixed gas of Ne and Xe or the like may be used as discharge gases. Here, in the narrow tubes 60 including a red phosphor layer 61R, the fraction of Ne contained in the discharge gas is set high (a mixed gas of Ne and Xe containing 5% Xe by volume), in the narrow tubes 60 including a green phosphor layer 61G, the fraction of Ne contained in the discharge gas is reduced (a mixed gas of Ne and Xe containing 10% Xe by volume) and, in the narrow tubes 60 including a blue phosphor layer 61B the fraction of Ne contained in the discharge gas is further reduced, and the fraction of Xe contained is further increased (a mixed gas of Ne and Xe containing 15% Xe by volume).

For the narrow tubes 60 including a red phosphor layer in this way, by increasing the quantity of contained neon, emission color from the red phosphor layer is enhanced by the red emission due to the neon, and both an improvement in the color purity and an increased discharge efficiency are possible. Meanwhile, for the narrow tube 60 including a blue phosphor layer 61B, by reducing the quantity of contained neon, red emission is suppressed and ultra violet light emission increased due to the increased quantity of Xe, and an increase in emission from the blue phosphor layer 61B is therefore possible. Using these techniques, the color temperature when white is displayed can be increased.

Further, the narrow tubes 60 including red phosphor layers 61R and green phosphor layers 61G may be filled with the discharge gas at a pressure of 400 Torr (53.2 kPa), and the narrow tubes 60 including the blue phosphor layers may be filled with the discharge gas at a pressure of 500 Torr (66.5 kPa). Using this technique, emission from the blue phosphor layer can be increased, and hence the color temperature when white is displayed can be increased.

Hence, a high definition PDP can be offered by adjusting, in this way, the pressures and compositions of the discharge gases filling the narrow tubes 60 according to type of phosphor layer included therein.

(PDP Manufacturing Method)

Figure 5A:
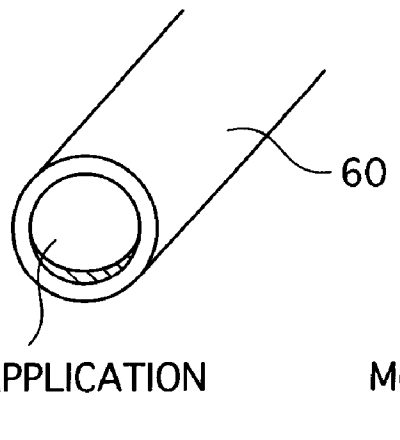
FIGS. 5A, 5B and 5C describe the manufacturing process for a PDP.

Phosphor Layer and MgO Layer Forming Process:

Glass tubes to be used as material for the narrow tubes 60 are prepared, phosphor application fluid (a fluid with dispersed binder and phosphor) is poured into the glass tubes, and the arrangement is dried with the axes of the glass tubes held horizontal. By this method, phosphor ink layers are formed on the lower part of the inner surface of the narrow tubes 60, as shown in FIG. 5A. By firing this arrangement the phosphor layers 61 are formed inside the narrow tubes 60. The dimensions of the narrow tubes 60 are, for example, outside diameter 1.0 mm, inside diameter, 0.9 mm and length 130 cm.

Figure 5B:
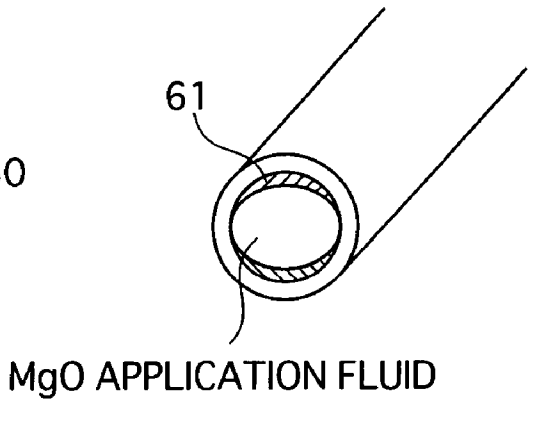
Figure 5C:
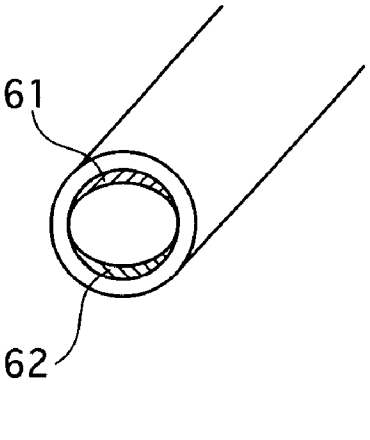

Next, with the phosphor layer on the upper side as shown in FIG. 5B, MgO application fluid (a fluid with dispersed binder and MgO) is poured into the narrow pipes, and the arrangement is dried with the glass tubes held in a horizontal position. By firing this arrangement narrow glass tubes with phosphor layers 61 and opposing MgO layers as shown in FIG. 5C are formed.

Note that though the order in which the MgO layers 62 and the phosphor layers 61 are formed may be reversed, it is preferable to form the phosphor layers 61 first and the MgO layers 62 second as described above so as to avoid the phosphors adhering to the surface of the MgO layer 62. Note also that after applying the phosphor application fluid and drying the arrangement, the MgO fluid can be applied and dried without first firing the arrangement, in which case the phosphor and the MgO layer are fired simultaneously.

The required number of narrow tubes 60 with a layer of red phosphor 61R formed within, the required number of narrow tubes 60 with a layer of green phosphor 61G formed within and the required number of narrow tubes 60 with a layer of red phosphor 61B formed within are manufactured in this way.

Discharge Gas Enclosing Process:

To enclose discharge gases of predetermined compositions at predetermined pressures, the narrow tubes 60, each with a phosphor layer 61 and an MgO layer 62 formed within, are collected into groups of each color. Then, after being connected to a vacuum pump and evacuated, the narrow tubes have discharge gases introduced internally and their end parts heat-sealed.

Data Electrode and Rib Forming Process:

The data electrodes 52 and the ribs 53 are formed on the substrate 51. The data electrodes 52 may be formed by applying a conductive paste in a pattern and then firing the arrangement or, alternatively, by bonding aluminum-strings (narrow strips of aluminum foil) onto the substrate 51. The ribs 53 are formed by applying a glass material or a resin in a pattern, and then curing the arrangement.

Note that the order in which the data electrodes and the ribs are formed is not important; either process may take precedence.

Note also that the ribs 53 are not strictly necessary, but forming the ribs makes it easier to align the narrow tubes.

Narrow Tube Aligning Process:

The narrow tubes 60 enclosing the discharge gases are arrayed on the substrate 51. Here, ribs 53 have been formed on the substrate 51 and so arraying is easily achieved by disposing the narrow tubes 60 in the grooves 54 between the ribs. Then, a bonding layer 63 is formed by applying a bonding agent in the gaps between the aligned narrow tubes 60. The aligned narrow tubes 60 immobilize each other via the bonding layer 63.

Discharge Electrode Forming Process:

Discharge electrodes 71*a* and 71*b* are disposed on top of the arrayed narrow tubes 60.

The discharge electrodes 71*a* and 71*b* may be formed by sticking down aluminum-strings (narrow strips of aluminum foil), or by applying a conductive paste in a pattern and then firing the arrangement.

Since the surfaces of the narrow tubes 60 are curved, it is difficult to form electrodes having a uniform width when a method such as screen printing or photolithography is used to apply conducting paste in a pattern. However, when an aluminum-string sticking method or a nozzle scanning method in which a nozzle scans along the surface of the arrayed narrow tubes 60 is used, electrodes of a uniform width can be formed

Effects According to the Manufacturing Method of the Present Embodiment

According to the manufacturing method of this embodiment, narrow tubes 60, which have the phosphor layers 61 formed within, have two or more discharge gases enclosed and are then arrayed on the substrate 51. Hence, for each narrow tube 60, the pressure and the composition of the discharge gas to be enclosed can easily be adjusted. Moreover, unlike the Embodiment 1, there is no need for a process to combine the two panels in an airtight manner.

Example Modifications to the First and Second Embodiments

Although in the Second Embodiment only one substrate is used, a second substrate may be provided on top of the arrayed plurality of narrow tubes 60 on the substrate 51, sandwiching the plurality of narrow tubes 60 between the two substrates. In such a case, the discharge electrodes 71*a* and 71*b* may be formed on the second substrate.

In the PDP described in the Second Embodiment, phosphor layers are provided on the inside surface of the narrow tubes 60. However, instead of phosphor layers on the inside surface of the tubes, light emitting materials of each color, which excitedly emit red, green and blue light under ultraviolet light, may be added to the glass material that forms the narrow tubes 60. Some possible examples for the light emitting materials of each color are $Eu_2O_3$ for the red light emitting material, $Tb_2O_3$ for the green light emitting material, and $EuF_2$ for the blue light emitting material.

In the Second Embodiment, since the end parts of each narrow tube 60 are sealed, the narrow tubes 60 including the red phosphor layers 61R, the narrow tubes 60 including the green phosphor layer 61G and the narrow tubes 60 including the blue phosphor layer 61B are all independent of one another. However, narrow tubes 60 containing any two of the phosphor layers may be connected, in which case the composition and pressure of the gas in contact with the phosphor layers of the two colors is the same. Where, for example, the narrow tubes 60 including the red phosphor layer are connected to the narrow tubes 60 containing the green phosphor layer, the internal space is divided in substantially the same way as for Example 1 above; where the narrow tubes 60 including the green phosphor layer are connected to the narrow tubes 60 including the blue phosphor layer, the internal space is divided in substantially the same way as for Example 2 above; and where the narrow tubes 60 including the red phosphor layer are connected to the narrow tubes 60 including the blue phosphor layer, the internal space is divided in substantially the same way as for Example 3 above.

In the First and Second Embodiments, the pressure at which the discharge gas is enclosed may be less than atmospheric pressure or greater than atmospheric pressure. Also, each discharge electrode may be divided into a plurality of narrow lines. In such a case, each line electrode may be formed using aluminum wire.

In the First and Second Embodiments, a PDP having phosphor layers of the three colors, red, green and blue is described, but the present invention may be implemented on any PDP having phosphor layers of two or more colors in a similar way.

In the First and Second Embodiments, the directions of the discharge electrodes and the data electrodes may be reversed, the discharge electrodes being provided in the direction in which the phosphor layers of each color extend, and the data electrodes being provided in a direction at right angles to the discharge electrodes.

In the First and Second Embodiments, a surface discharge PDP is described, but a similar implementation is possible in an opposing discharge type of PDP. Furthermore, the present invention may be widely applied to any image display device that includes a plurality of phosphor types in an internal space in which a discharge gas is enclosed.

INDUSTRIAL APPLICABILITY

The present invention may be utilized in computer and television image display apparatus, for example, especially in large type image display apparatus.

According to the present invention, since superior color emission can be obtained and the lifetime of the phosphor layers can be extended, a high definition image display apparatus can be provided

The invention claimed is:

1. An image display apparatus in which a pair of substrates are disposed opposite one another such that an internal space is formed therebetween, electrodes and at least two types of phosphor layer are provided between the substrates, and discharge gas is enclosed in the internal space, the image display apparatus displaying an image by applying voltages to the electrodes so as to cause discharges to occur in the internal space, and via the phosphor material, converting ultraviolet light generated as discharges occur into visible light, comprising:

the internal space is partitioned by a plurality of barrier ribs in a stripe pattern which form a plurality of grooves, and among the grooves, (a) grooves constituting a first space are closed at one end by auxiliary barrier ribs and connect with one another at an other end and (b) grooves constituting a second space are closed at the other end by auxiliary barrier ribs and connect with one another at the one end such that (i) the internal space is divided into the first space provided with a first phosphor layer and the second space provided with a second phosphor layer and (ii) the grooves constituting the first space connect with one another and the grooves constituting the second space connect with one another, and the discharge gases respectively enclosed in the first and second spaces differ from each other in at least one of composition and pressure.

2. The image display apparatus of claim 1, wherein, the first phosphor layer is of at least one color selected from red, green and blue, and the second phosphor layer is of at least one color other than the at least one color selected for the first phosphor layer.

3. The image display apparatus of claim 1 wherein the image display apparatus is a plasma display television set with a plurality of pairs of discharge electrodes arranged on a facing surface of a first substrate of the pair of substrates.

4. An image display apparatus manufacturing method comprising:

an outer vessel forming step of forming an outer vessel in which pair of substrates are disposed opposite one another such that an internal space is formed therebetween;

electrodes and at least two types of phosphor layer are provided between the substrates;

discharge gas is enclosed in the internal space, the internal space is provided with a first phosphor layer and a second space provided with a second phosphor layer, and partitioned by a plurality of barrier ribs in a stripe pattern which form a plurality of grooves, and among the grooves, (a) grooves constituting a first space are closed at one end by auxiliary barrier ribs and connect with one another at an other end and (b) grooves constituting a second space are closed at the other end by auxiliary barrier ribs and connect with one another at the one end such that (i) the internal space is divided into the first space provided with a first phosphor layer and the second space provided with a second phosphor layer and (ii) the grooves constituting the first space connect with one another and the grooves constituting the second space connect with one another, first and second exhaust tubes connecting to the first and second spaces respectively are provided; and an exhausting-enclosing step of, via the first and second exhaust tubes respectively, exhausting the first and second spaces and enclosing discharge gas therein, wherein, in the exhausting-enclosing step, the discharge gases respectively enclosed in the first and second spaces differ from each other in at least one of composition and pressure.

5. The image display manufacturing method of claim 4, wherein, the first phosphor layer is of at least one color selected from red, green and blue, and the second phosphor layer is of at least one color other than the at least one color selected for the first phosphor layer.

* * * * *